US005385275A

United States Patent [19]

Billet

[11] Patent Number: 5,385,275

[45] Date of Patent: Jan. 31, 1995

[54] PORTABLE BEVERAGE DISPENSER WITH ANTI-FOAMING TANK

[75] Inventor: Robert L. Billet, North Wales, Pa.

[73] Assignee: Robert Billet Promotions, Inc., Ambler, Pa.

[21] Appl. No.: 144,176

[22] Filed: Oct. 27, 1993

[51] Int. Cl.[6] ..... B67D 5/00

[52] U.S. Cl. ..... 222/399; 222/175; 222/396; 141/18

[58] Field of Search ..... 141/18, 21; 222/188, 222/399, 175, 377, 278, 131, 383, 396, 397

[56] References Cited

U.S. PATENT DOCUMENTS

| | | | |
|---|---|---|---|
| 486,760 | 11/1892 | Bumann | 222/377 X |
| 1,356,657 | 10/1920 | Phister | 222/175 |
| 1,410,878 | 3/1922 | Benshoof | 222/377 X |
| 1,673,007 | 6/1928 | Kaiser | 222/175 |
| 2,105,339 | 1/1938 | Sweitzer | 222/175 |
| 2,350,184 | 5/1944 | Oys | 224/148 |
| 2,526,221 | 10/1950 | Goddard | 222/399 |
| 2,558,181 | 6/1951 | Kassel | 222/175 |
| 2,684,787 | 7/1954 | Charpiat | 222/175 |
| 2,704,627 | 3/1955 | Brulin et al. | 222/175 |
| 2,732,977 | 1/1956 | Charpiat | 222/175 |
| 2,808,965 | 10/1957 | Graphia, III et al. | 222/175 |
| 2,873,051 | 2/1959 | Hamburg et al. | 222/399 X |
| 3,147,889 | 9/1964 | Dolgin | 222/175 |
| 3,286,884 | 11/1966 | Long, Jr. | 222/175 |
| 3,645,291 | 2/1972 | Finney | 141/18 X |
| 4,201,319 | 5/1980 | Andera et al. | 222/399 X |
| 4,520,953 | 6/1985 | Fallon | 222/399 X |
| 4,921,143 | 5/1990 | Billet | 222/175 |
| 4,997,111 | 3/1991 | Lowers | 222/399 X |
| 5,275,313 | 1/1994 | Petrillo et al. | 222/377 |
| 5,282,561 | 2/1994 | Mihalich | 222/399 X |

*Primary Examiner*—Andres Kashnikow
*Assistant Examiner*—Anthoula Pomrening
*Attorney, Agent, or Firm*—Caesar, Rivise, Bernstein, Cohen & Pokotilow, Ltd.

[57] ABSTRACT

A portable beverage dispenser for use by a vendor. The dispenser comprises a tank worn on the back of the vendor and having an insulated internal chamber for receiving a carbonated beverage to be dispensed by a pressurized gas in the chamber, a filling conduit for filling the chamber with the carbonated beverage, a pressurized gas supply for pressurizing the chamber, and an outlet nozzle. The chamber has a concave bottom wall with a small concave recess at its nadir. The conduit extends into the chamber at an acute angle to the chamber's longitudinal axis and has a port centered on that axis immediately adjacent the concave recess. The conduit carries carbonated beverage into the chamber so that the beverage enters the recess and quickly fills it with minimal foaming and so that the level of the beverage in the chamber is above the port to ensure that further filling of the chamber is also accomplished with minimal foaming. The supply of the pressurizing gas comprises a thermally insulative vessel holding a gas in a liquid phase for selective release to allow the liquified gas to change to its gaseous phase at a high pressure for introduction into the dispensing chamber to pressurize the dispensing chamber, whereupon a portion of the beverage is dispensed from the dispensing chamber via the nozzle.

10 Claims, 7 Drawing Sheets

PORTABLE BEVERAGE DISPENSER WITH ANTI-FOAMING TANK

BACKGROUND OF THE INVENTION

This invention relates generally to portable beverage dispensers, and more particularly to portable beverage dispensers which can be readily filled with a carbonated beverage without resulting in undue foaming of the beverage.

It is quite common at athletic events and other events which draw large crowds for vendors selling or dispensing hot and cold beverages to circulate among the people. For example during sporting events, such as baseball and football games, it is common for vendors to carry containers of soda, beer, coffee, hot chocolate, etc. for sale to the fans. This has proven to be a cumbersome and relatively expensive means of distributing beverages.

There also have been numerous suggestions in the prior art of providing portable beverage dispensers having tanks from which a beverage to be dispensed is retained, and from which the beverage is directed, through a dispensing nozzle, and into a paper or plastic cup. Representative beverage dispensers of this type are disclosed in U.S. Pat. Nos. 1,673,007 (Kaiser); 2,105,339 (Sweitzer); 2,350,184 (Oys); 2,558,181 (Cassel); 2,684,787 (Charpiat); 2,704,627 (Brulin et al. ); 2,732,977 (Charpiat); 2,808,965 (Graphia III, et al.); 3,147,889 (Dolgin); and 3,286,884 (Long, Jr.)

In my U.S. Pat. No. 4,921,143, whose disclosure is incorporated by reference herein, there is disclosed a portable beverage dispenser which overcomes many of the disadvantages of the prior art. That dispenser is adapted to be carried by a vendor and basically comprises an insulated tank having an internal compartment or chamber in which a beverage to be dispensed is retained. A discharge passage is provided through a wall of the insulated tank and communicates with the internal chamber adjacent a lower end of the chamber. A pressurizing passage extends through a wall of the tank and communicates with the chamber adjacent an upper end of the chamber. A pump is attached to the tank and includes a fluid transmitting line for directing a pressurizing gas into the upper end of the chamber through the pressurizing passage for pressurizing a beverage within the compartment, and a nozzle communicates with the discharge passage adjacent the lower end of the chamber for dispensing the beverage. In a preferred embodiment a cup dispenser also is attached to the insulated tank, and most preferably both the pump and the cup dispenser are attached to sidewall sections of the tank.

While the beverage dispenser of my aforementioned patent is generally suitable for its intended purposes it never the less leaves something to be desired from the standpoints of its ability to be filled with carbonated beverages without undue foaming, and its resistance to dispensing particulate matter with the beverage.

OBJECTS OF THE INVENTION

Accordingly, it is a general object of this invention to provide a portable beverage dispenser which overcomes the disadvantages of the prior art.

It is a further object of this invention to provide a portable beverage dispenser which is constructed so that any particulate material or sediment in the beverage is trapped within the dispenser during the beverage dispensing operation.

It is still a further object of this invention to provide a portable beverage dispenser having an anti-foaming fillable dispensing tank which is simple in construction and effective in operation.

It is yet a further object of this invention to provide a portable beverage dispenser having a particulate material/sediment trapping dispensing tank which is simple in construction and effective in operation.

SUMMARY OF THE INVENTION

These and other objects of this invention are achieved by providing a portable beverage dispenser for use by a vendor. The dispenser comprises a tank having an internal chamber for receiving a carbonated beverage to be dispensed, conduit means for filling the chamber with the carbonated beverage, and pressurization means for pressurizing the chamber to dispense a portion of the carbonated beverage from the chamber.

The chamber has a longitudinal axis and comprises a concave bottom wall having a concave recess at its nadir which is centered on the axis. The concave recess has a substantially smaller radius of curvature and volumetric capacity than the bottom wall. The conduit means extends into the chamber at an acute angle to the longitudinal axis and has a port centered on the axis and disposed immediately adjacent the concave recess. The conduit means is arranged to carry a carbonated beverage therethrough and out of said port into the chamber, whereupon the beverage enters the recess and quickly fills it with minimal foaming and so that the level of the beverage in the chamber is above the port so that further filling of the chamber with the beverage is also accomplished with minimal foaming.

The pressurizing means pressurizes the chamber with a gas above the level of the carbonated beverage in the chamber to dispense a portion of that beverage from the chamber.

In accordance with one preferred aspect of the invention the pressurizing means comprises a vessel having a gas in a liquid phase located therein. The vessel is in communication with the chamber via conduit means, e.g., a plurality of coils, to selectively enable the liquified gas to exit from the vessel, pass into the conduit means, whereupon it returns to its gaseous phase, with the gas being at an elevated pressure, and from there the gas enters into the chamber to pressurize the chamber.

DESCRIPTION OF THE DRAWINGS

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENTS

Figure 1:
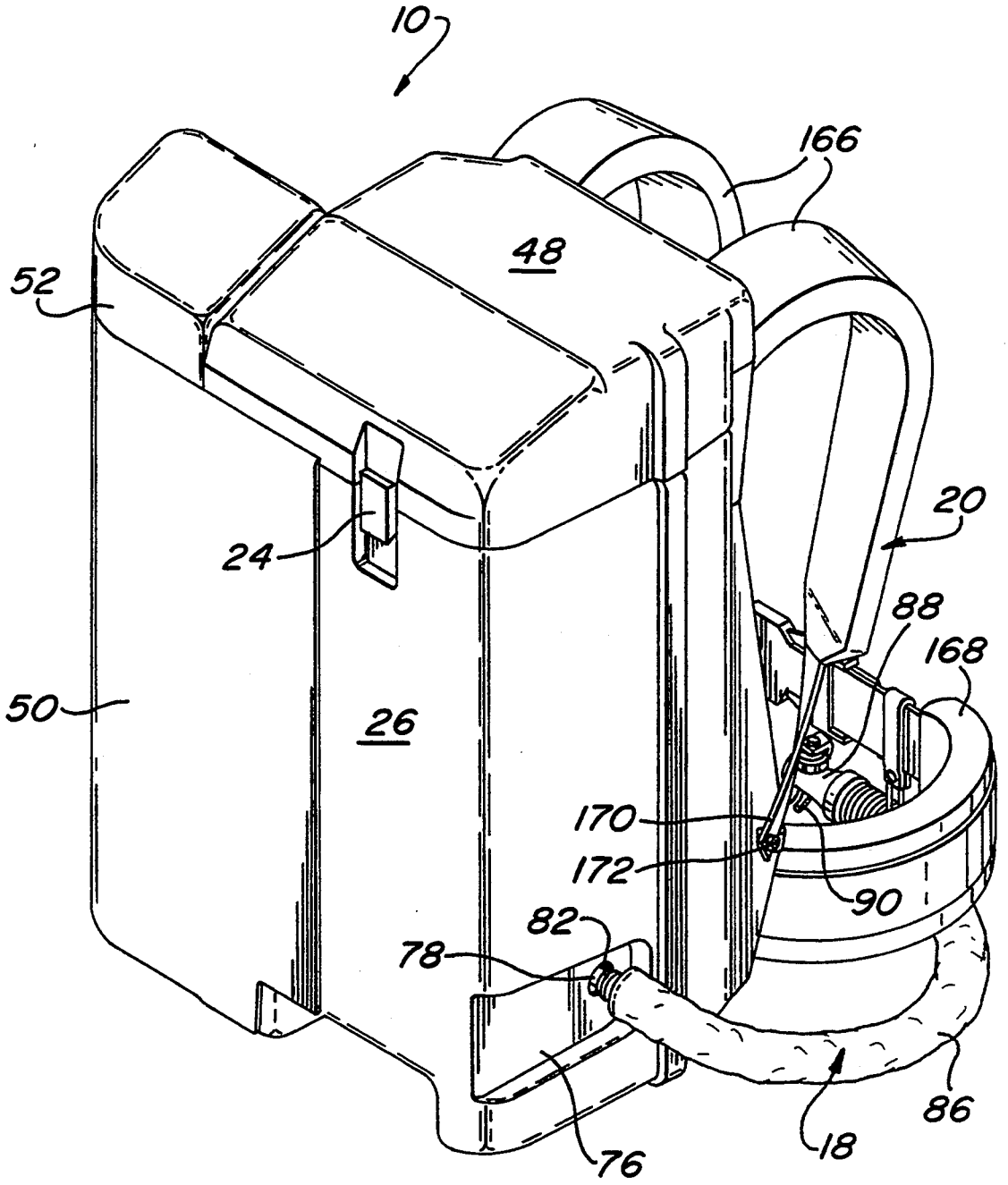
FIG. 1 is a front isometric view of a portable beverage dispenser constructed in accordance with this invention.
Figure 2:
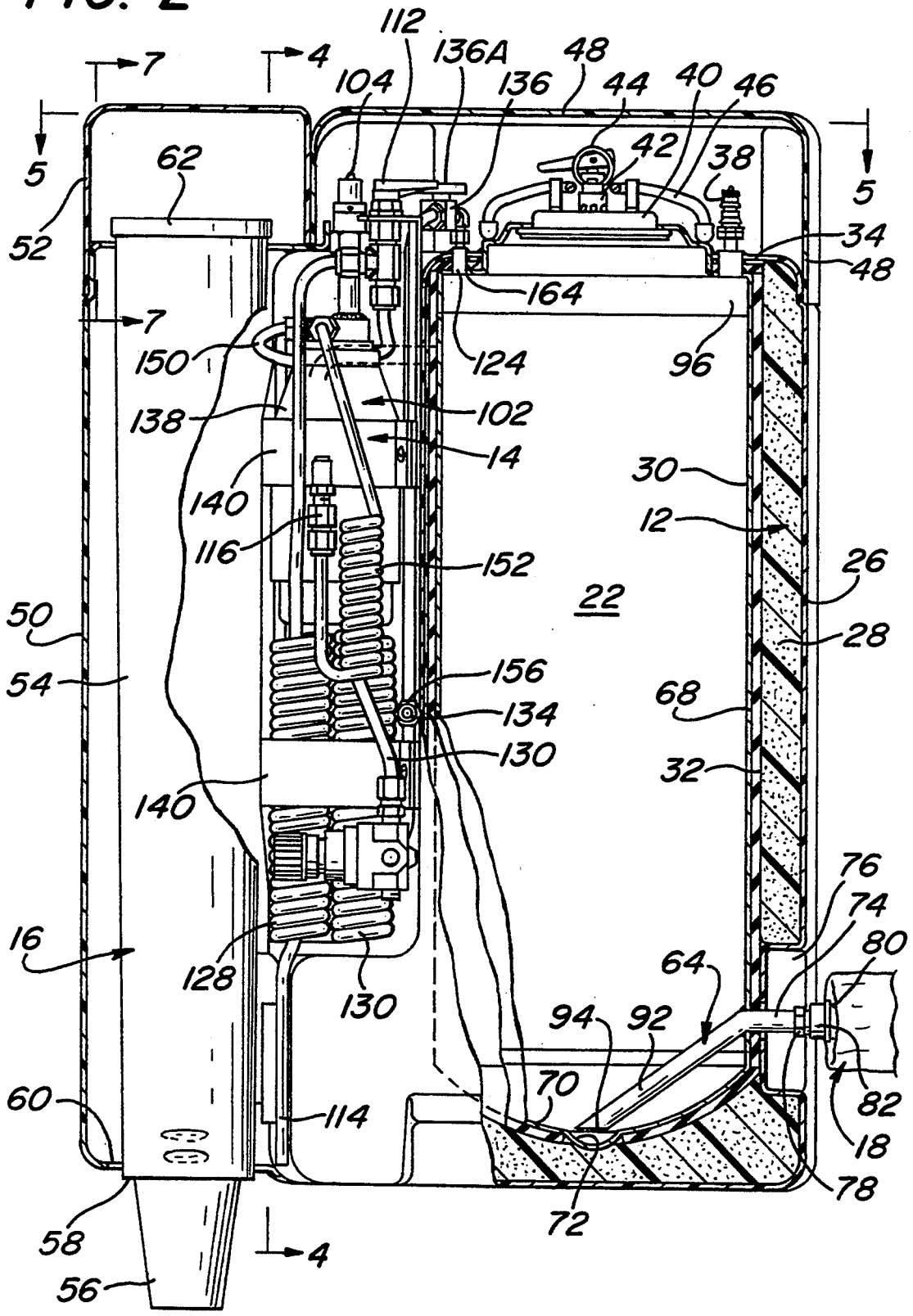
FIG. 2 is an enlarged front elevational view, partially in section of the portable beverage dispenser shown in FIG. 1.
Figure 3:
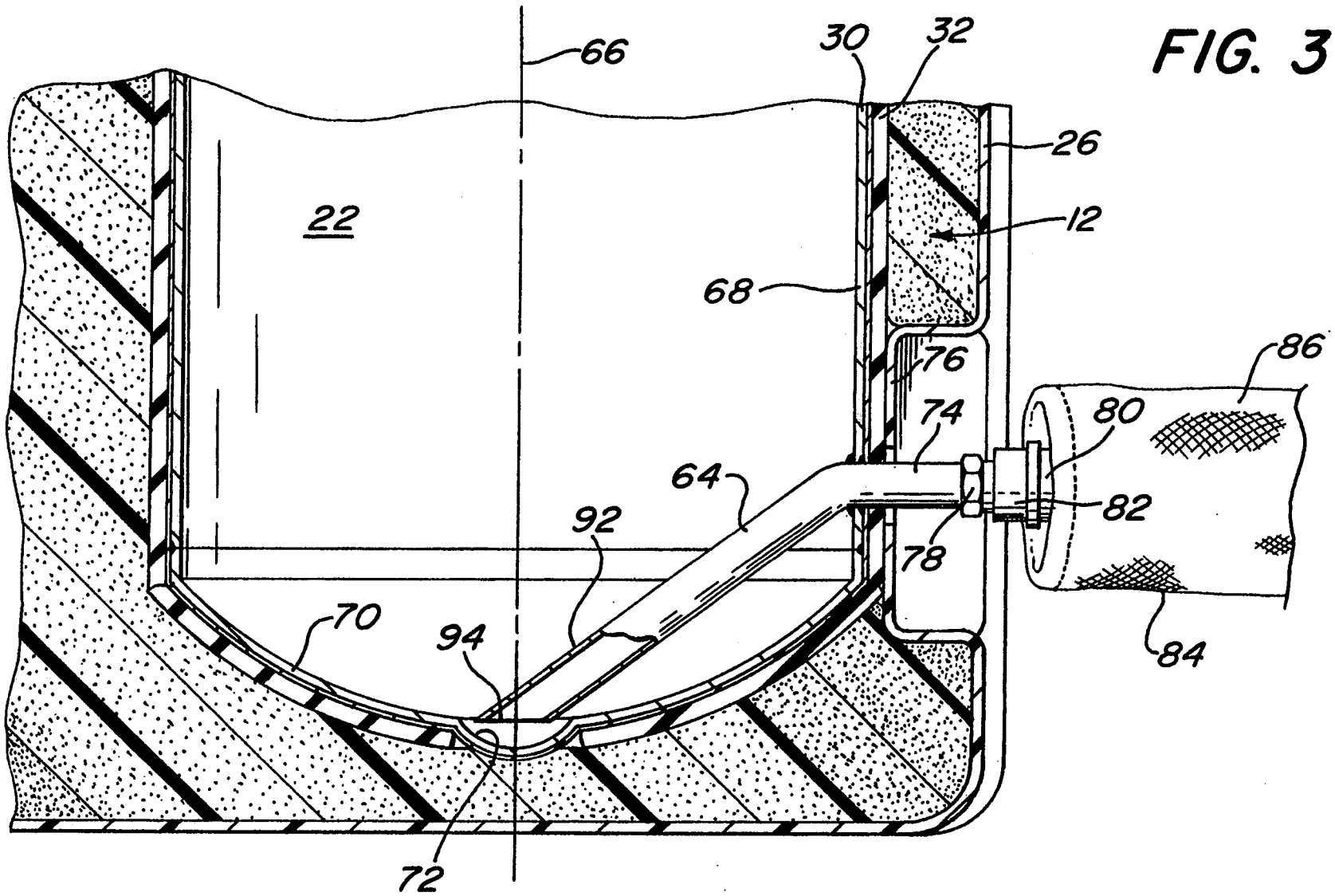
FIG. 3 is an front elevational view, partially in section, of a portion of the beverage dispenser shown in FIG. 2.

Referring now to various figures of the drawing where like reference numerals refer to like parts, there is shown in FIG. 1, a portable beverage dispenser 10 constructed in accordance with this invention. The dispenser 10 is arranged to dispense any type of beverage therefrom, and is particularly suited for used with carbonated beverages, such as beer or soda, or beverages having some particulate material or sediment therein, e.g., coffee. The dispenser basically comprises an insulated tank 12 (FIGS. 2, 3, and 5) containing a chamber 22 (to be described later) in which the beverage to be dispensed is held, a gas pressurizing system 14 (FIGS. 2, 4, 5, and 8) for pressurizing the interior of the chamber above the level of the beverage with a gas to dispense the beverage, a cup dispenser 16 (FIGS. 2 and 5) for retaining a stack of paper or plastic cups to be dispensed one at a time, and a dispensing hose and nozzle assembly 18 (FIGS. 1-3). The hose and nozzle assembly 18 is releasably coupled to the tank 12 by a valve (to be described later) so that the hose and nozzle assembly can be removed and a carbonated beverage introduced through the valve into the bottom of the chamber in the tank. As will also be described later the bottom of the chamber is constructed to prevent any substantial foaming of the beverage during the filling operation. A strap assembly 20 (FIG. 1) is provided for supporting the dispenser 10 on the back of a vendor.

Figure 4:
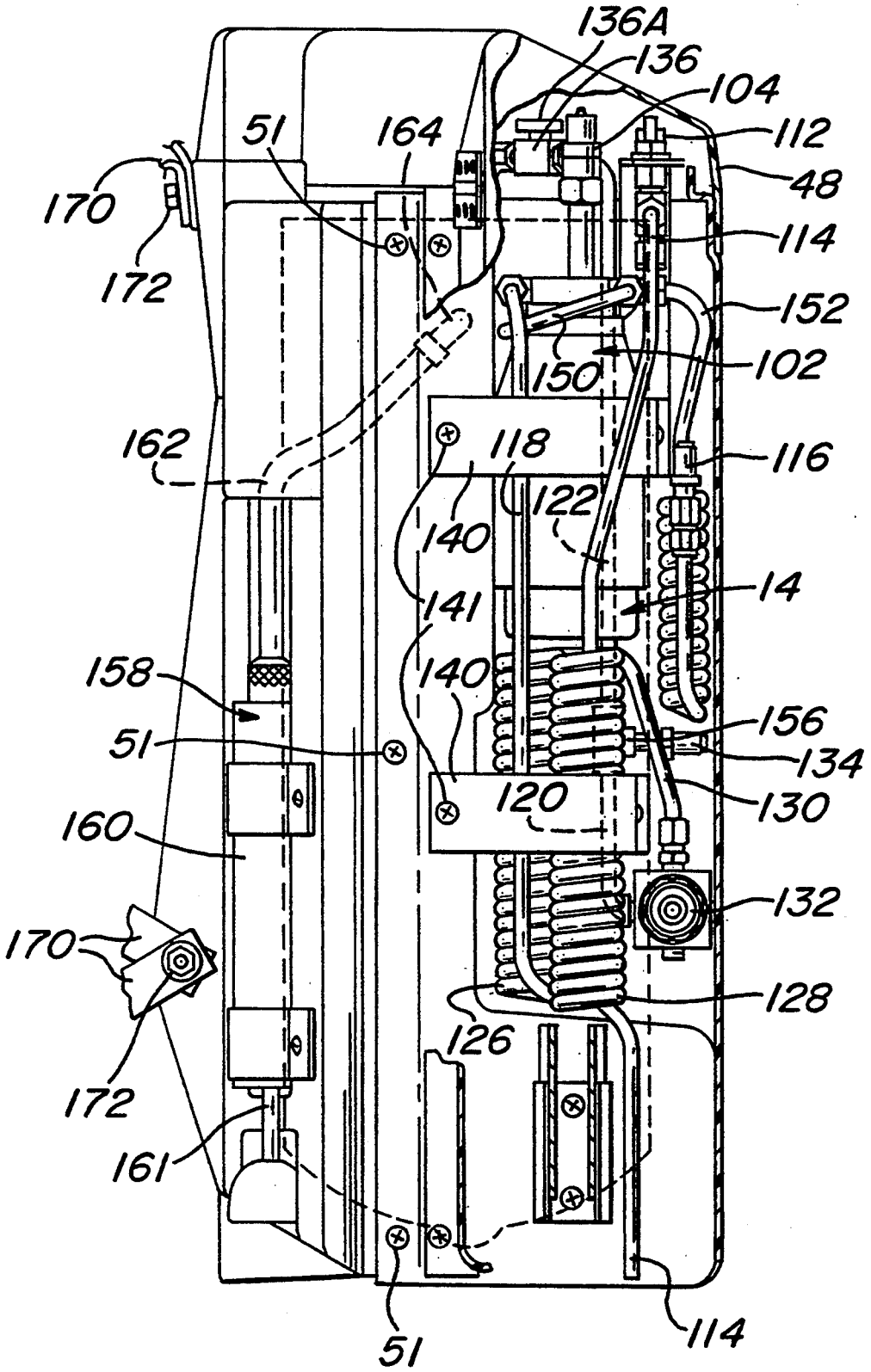
FIG. 4 is a sectional view taken along line 4—4 of FIG. 2.
Figure 5:
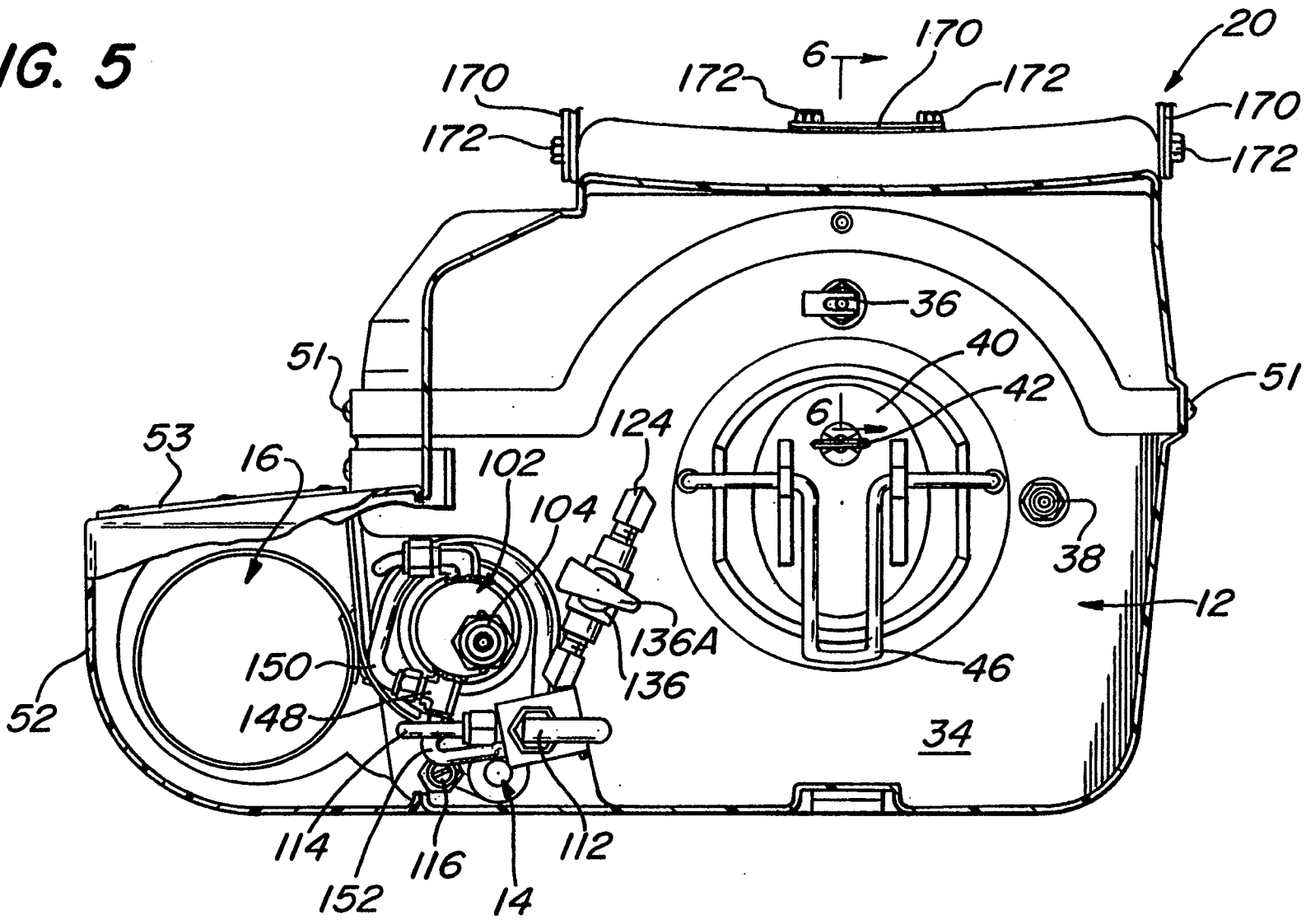
FIG. 5 is a sectional view taken along line 5—5 of FIG. 2.
Figure 6:
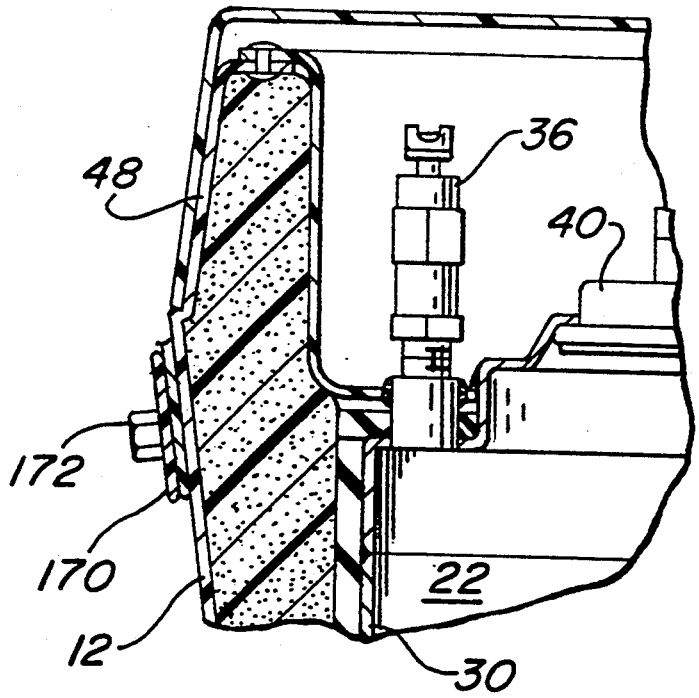
FIG. 6 is a sectional view taken along line 6—6 of FIG. 5.

Referring specifically to FIGS. 4, 5 and 6, the insulated tank 12 includes the heretofore mentioned internal compartment or chamber 22 for retaining the beverage to be dispensed. The tank 12 includes a 2-ply, peripheral wall construction including an outer plastic wall 26 and a foam insulating central core 28. The chamber 22 comprises an inner stainless steel wall 30 and a multi-layered mylar neoprene rubber jacket 32 surrounding virtually all surfaces of the stainless steel wall except its top and lowest bottom portion. It should be understood that stainless steel is employed for the chamber 22 for sanitation purposes.

The upper end of the tank 12 is constructed in like the upper end of the tank of my aforementioned patent. Thus, as can be seen in FIG. 5, the upper end of the tank 12 includes a generally planar upper wall 34, and this upper wall is provided with a pressure relief valve 36 and a quick disconnect, one-way check valve 38, both of which communicate with the internal chamber 22. The quick disconnect valve 38 is employed to fill the chamber 22 with a non-carbonated beverage (as mentioned earlier carbonated beverages are introduced into the bottom of the chamber to prevent foaming). The pressure relief valve 36 is provided to prevent excessive pressure build-up within the chamber 22.

It should be understood that the quick disconnect valve 38 is of a conventional construction and includes a normally closed valve which is automatically opened when it is connected to a mating valve section associated with the source of the beverage employed to fill the dispenser 10.

A cap 40, like that disclosed in my aforementioned patent, is provided to form a gas-tight seal for an access aperture in the upper wall 34 of the tank. This access aperture preferably is employed to introduce a cleaning solution into the chamber 22 for the purpose of cleaning it at reasonable intervals, or when a change in the beverage to be dispensed is desired. Also, when a portion of the beverage is left in the tank at the end of a day, or the beverage either becomes too warm or too cold to be marketable, it easily can be disposed of by removing the cap from the enlarged access aperture and pouring out the contents of the chamber 22 therethrough. The cap 40 includes a pressure relief valve 42 as a safety feature. The pressure relief valve has a finger-engageable loop 44 which is manually pulled in an upward direction to relieve the internal pressure within the chamber before the gas-tight seal formed by the cap is broken. A locking bale 46 is provided to produce a force on the cap 40 for establishing the fluid-tight seal.

Referring to FIGS. 1 and 2, a hard plastic cover 48 is attached to the upper end of the tank 12 by a hinged connection (not shown), to permit the cover to be pivoted into a position overlying the upper wall 34 of the tank 12. The cover 48 is held in place over the top wall of the tank by a clasp 24 and serves to protect the various valves and fittings in the upper wall of the tank, and also provides a desirable aesthetic appearance for the overall beverage dispenser.

Figure 7:
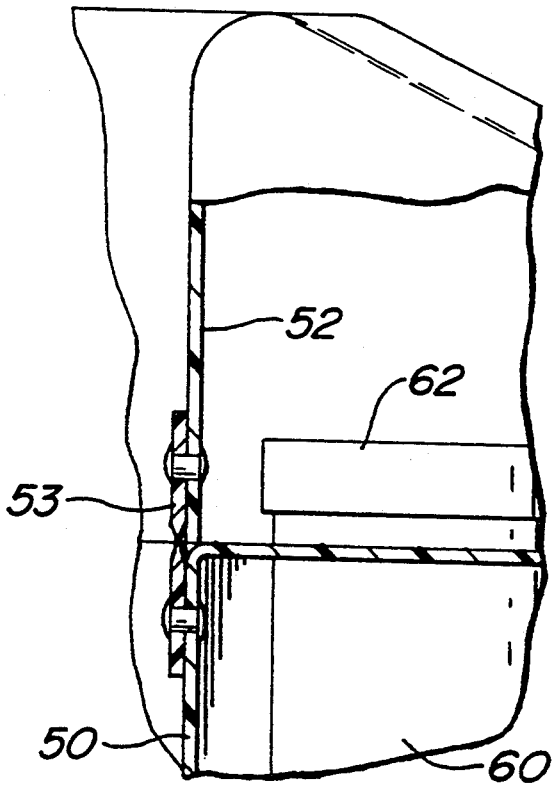
FIG. 7 is a sectional view taken along line 7—7 of FIG. 2.

Referring specifically to FIGS. 2 and 5, the cup dispenser 16 is mounted within a hollow, elongated hard plastic housing extension 50 releasably secured via plural threaded fasteners 51 along one side of the outer wall 26 of the tank 12. The housing extension 50 extends for virtually the entire height of the tank. A cover 52 is attached to the upper end of the housing extension by a hinge 53 (FIG. 7). The cup dispenser 16 is constructed similarly to the dispenser of my aforementioned patent and thus basically comprises a cylindrical cartridge 54 mounted by any suitable means (not shown) so that it extends along the length of the tank 12 from the top end to the bottom end. The cartridge is arranged for receiving a nested stack of cups 56 therein. These cups are dispensed one at a time through an open bottom 58 of the cartridge and through a corresponding opening 60 in the bottom of the housing extension. A removable cap 62 is provided at the top of the cartridge 54 to enable the stack of cups to be inserted therein. The hinged cover 52 is arranged to be pivoted back from the housing extension 50 to expose the cap 62 at the top of the cup cartridge 54. Thus, the cover 52 provides access to the cap at the top of the cartridge so that the cap can be removed to enable the cups to be inserted into the cartridge.

Referring now to FIGS. 2 and 3 the details of the bottom of the internal chamber 22 will now be considered. It is the shape of the bottom of the chamber, and the construction and orientation of a conduit 64 for introducing carbonated beverages into the interior chamber 22, which ensures that virtually no foaming of those beverages occurs. In particular, as can be seen in FIGS. 2 and 3 the chamber 22 is of generally cylindrical shape and has a longitudinal central axis 66. The chamber includes a circular sidewall 68 extending about the axis 66 and terminating at its bottom in a hemi-spherical bottom wall 70. A very small concave recess 72, also of hemi-spherical shape, is located at the nadir of the bottom wall 70 on the axis 66. The radius of curvature of the recess 72 is substantially smaller than the radius of curvature of the hemi-spherical shaped bottom wall 70 and is also of substantially lesser volumetric capacity.

The filling/dispensing conduit 64, is provided to fill the chamber 22 with carbonated beverages and to carry any type of beverage from the interior of the chamber into the hose and nozzle assembly 18 to dispense that beverage. The conduit 64 is formed of any suitable material, e.g., stainless steel, and includes a horizontal portion 74 which extends through a recess 76 of the tank 12 at a point just above the point at which the chamber's sidewall 68 merges into its bottom wall 70. The outer end of the conduit portion 74 terminates in a quick disconnect fitting 78 forming a portion of the hose and nozzle assembly 18.

The assembly 18 is constructed similarly to the hose and nozzle assembly of my aforementioned patent and basically comprises a hose 80 having a quick disconnect fitting 82 at a rear end thereof which is adapted to be connected to the quick disconnect fitting 78 on the end of the conduit portion 74. The quick disconnect fitting 78 includes a normally closed valve (not shown) therein, which is opened automatically when it is connected to the mating fitting at the rear end of the hose. The hose 80 is surrounded by a thermal insulating cover 84, which preferably includes an internal inner neoprene rubber sleeve (not shown), a central foam layer (not shown), and an outer insulating fabric sleeve 86.

A conventional dispensing nozzle 88 (FIG. 1) is secured to the end of the hose 80 opposite the quick disconnect fitting 82, and includes a valve (not shown) which normally is spring-biased into a closed position. A trigger 90 (FIG. 1) is provided, which, when manually actuated, forces the valve of the nozzle into an opened position, thereby resulting in the dispensing of a beverage from the chamber 22 in the tank 12, through the hose and nozzle assembly 18, and into a cup 56 or some other receptacle held adjacent the nozzle.

As can be seen clearly in FIG. 3 inner end 92 of the conduit 64 extends radially inward and downward with respect to the chamber 22, so that its open free end 94 is disposed immediately adjacent and directly over the small concave recess 72. The angled orientation of the conduit portion 92 and the location of its open free end 94 cooperates with the shape of the bottom of the chamber to ensure that carbonated beverages introduced into the chamber through the conduit 64 do not foam up during the filling operation. This feature is of considerable importance in the vending of carbonated beverages, since foaming during filling degrades the beverage. The anti-foaming filling action of the chamber 22 occurs as follows: when it is desired to fill the chamber 22 with a carbonated beverage the hose and nozzle assembly 18 is disconnected from the tank 12. A source of the carbonated beverage (not shown) is connected to the quick disconnect fitting 78, whereupon the beverage flows through the valve in that fitting into the conduit 64 and out of the outlet 94 at the free end of the conduit. The exiting beverage flows into the recess 72. As the recess 72 fills, the beverage flows up the arcuate wall making up the recess with very little foaming. Since the recess is of such small volumetric capacity it fills up virtually instantly. Moreover, since the outlet of the conduit from which the beverage exits is at the top of the recess, once the recess has filled the outlet will be submerged. Accordingly, continued filling of the chamber 22 occurs from below the surface of the beverage, thereby minimizing, if not eliminating, further foaming. Moreover, the fact that the bottom wall 70 of the chamber 22 is hemi-spherical ensures that the beverage introduced through the conduit 64 displays very little turbulence, thereby contributing to the suppression of foaming. Once the chamber is filled to its desired capacity, the beverage source is disconnected from the quick release fitting 78 on the end of the conduit. This action causes the valve within that fitting to close to prevent any beverage from leaking out.

The hose and nozzle assembly 18 can then be reconnected to the quick connect fitting 78 to ready the dispenser 10 for dispensing the beverage from the tank. This operation will be described later, after a discussion of the pressurization system 14 for pressurizing the interior of the chamber 22. That system is shown clearly in FIGS. 2, 4, 5 and 8 and is arranged to deliver pressurized gas to the upper section 96 of the chamber 22 to provide downward pressure on the surface 98 (FIG. 8) of the beverage 100 for dispensing the beverage through the dispensing hose and nozzle assembly 18.

The system 14 basically comprises a cryogenic vessel 102 and associated filling valve 104, a gas pressure relief subassembly 106, a head pressure subassembly 108, and a gas expansion and transport subassembly 110. The details of each of these subassemblies will be described later. Suffice it for now to state the following: the cryogenic vessel 102 basically comprises a thermally insulative vessel used to store and maintain at a low temperature liquified a gas, e.g., liquid oxygen, liquid nitrogen, liquid carbon dioxide. The liquified gas is used as the supply of the gas to pressurize the chamber 22. The gas pressure relief subassembly 106 basically comprises a release valve 112 and a liquid bleed line 114 for venting to the ambient atmosphere any spuriously generated gas which may be created in the vessel 102 as it is filled with the liquified gas. The head pressure subassembly 108 basically comprises a preset pressure valve 116 for establishing the maximum pressure at the outlet of the vessel 102. The gas expansion and transport subassembly 110 basically comprises a plurality of straight conduit sections 118, 120, 122, and 124, three sequential coiled conduit sections 126, 128, and 130, an adjustable regulator 132, a check valve 134, and an ON/OFF valve 136. The subassembly 110 is arranged for enabling the liquified gas from the vessel 102 to vaporize within its conduits, whereupon the gas is returned to its native gaseous state, but at relatively high, regulated pressure, and to be transported to the top section 96 of the chamber 22 to pressurize it for beverage dispensing.

The cryogenic vessel 102 stores and maintains the liquified gas at a low pressure. This feature is of considerable importance insofar as safety is concerned. In order to maintain the liquified gas therein at the low pressure it must be kept at a very low temperature. Thus, the vessel 102 is thermally insulative. In particular, the vessel 102 is constructed of three rigid walls; an inner wall (not shown), an intermediate wall (not shown), and an outer wall 138. Each of these walls is constructed of steel wrapped with reflective Mylar. A vacuum space exists between the inner wall and the intermediate wall and between the intermediate wall and the outer wall. The vacuum spaces serve to insulate the interior of the cryogenic vessel from the ambient temperature, thereby permitting the liquified gas to remain in its liquid state.

As can be seen clearly in FIG. 2 the cryogenic vessel is mounted on the portable beverage dispenser tank by means of a bracket 140 and associated screws 141. A similar bracket 140 and screws 141 are used to hold the coils 126, 128, and 130 in place.

The filling of the cryogenic vessel 102 with liquified gas is accomplished as follows: a tank (not shown) containing the liquified gas is connected via a connector (not shown) which mates with the fill valve 104 located at the top of the cryogenic vessel. The fill valve 104 communicates with the interior of the vessel 102 via a port 142 (FIG. 8) and is of conventional construction. The fill valve 104 is normally closed to isolate the interior of the vessel 102 from the ambient atmosphere, and is opened automatically when a connector or coupling (not shown) on a tank of liquified gas is connected to it, whereupon the liquified gas flows in the direction of arrow 143 through the coupled connectors into the interior of the vessel 102.

Figure 8:
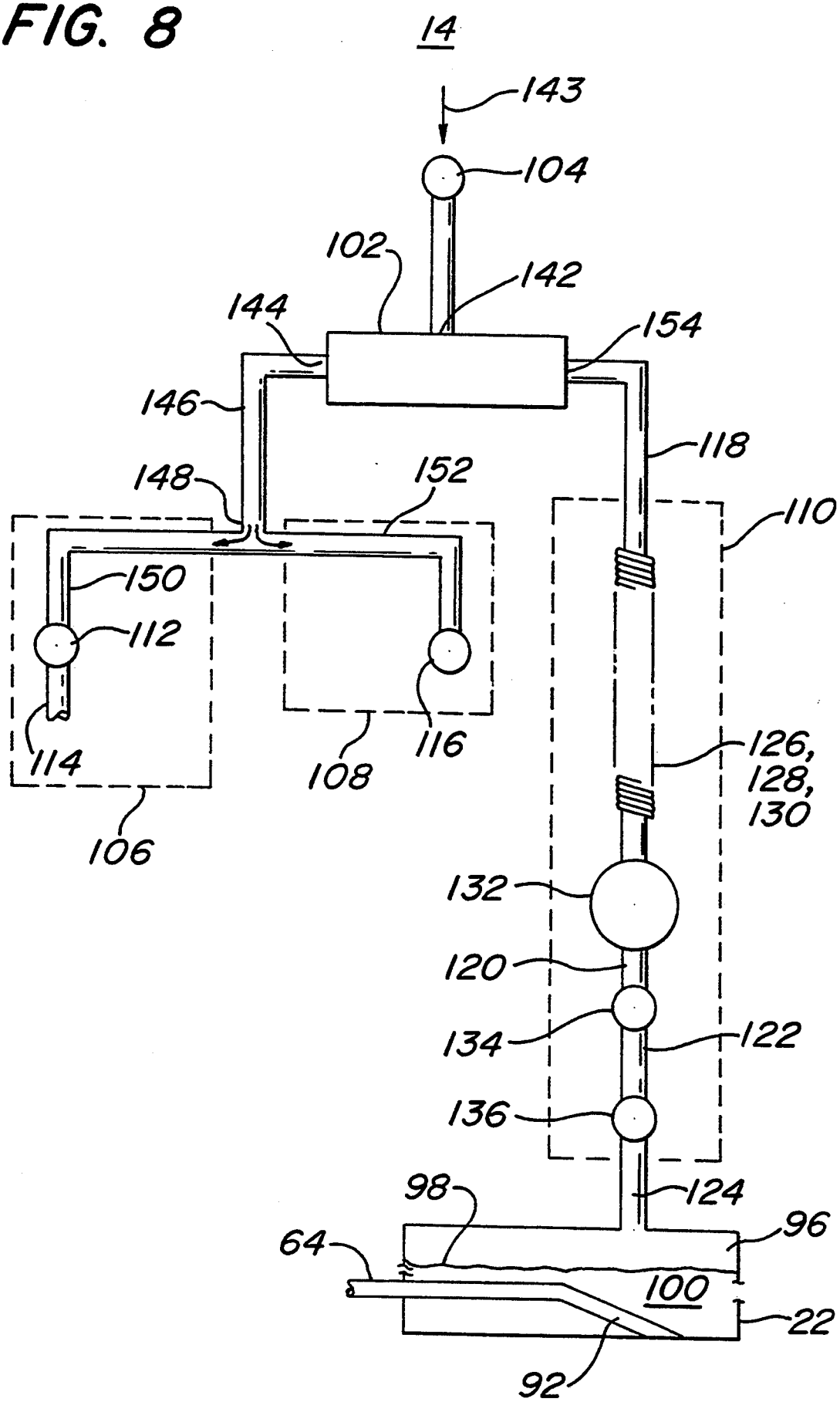
FIG. 8 is a shematic diagram of the tank pressurization system of the dispenser shown in FIG. 1.

As shown in FIGS. 5 and 8, the cryogenic vessel includes an outlet or opening 144 connected to and in fluid communication with a conduit 146. The conduit 146 is connected to the inlet of a T-connector 148 (FIGS. 5 and 8). One outlet of the T-connector is connected and in fluid communication with a conduit 150 (FIGS. 5 and 8) serving as the input of the gas pressure relief subassembly 106. The other outlet of the T-connector is connected and in fluid communication with a coiled conduit 152 (FIGS. 2 and 8) to the head pressure subassembly 108. It is through the outlet 144 that the any gas created by vaporization of the liquified gas as the liquified gas is introduced into the vessel 102 can escape. Prior to introducing the liquified gas through the fill valve 104 into the vessel 102, the gas pressure release valve 112 is opened. By opening this valve, a path is provided from the outlet 144 of the vessel 102 to the ambient atmosphere. Thus, as the cryogenic vessel 102 is being filled with the liquified gas, any spurious gas created by vaporization of the liquified gas as it comes in contact with the relatively warm interior wall of the vessel flows out of the outlet 144, through the conduit 146, the T-connector 148, the open bleed valve 112 and into the bleed line 114, where it vents to the ambient atmosphere. This action ensures that the vessel can be completely filled with liquified gas. In fact, the aforedescribed bleed path serves as a convenient means for indicating when the vessel is completely full of the liquified gas. In this regard when the vessel is completely full, if any more liquified gas is attempted to be introduced it will drip out of the bleed line, thereby indicating the vessel is full. When the vessel is full the gas release valve is closed and the source of the liquified gas is disconnected from the fill valve 104, thereby causing that valve to close to isolate the liquified gas within the cryogenic vessel.

The cryogenic vessel includes a second outlet 154 which is connected to the conduit 118. This conduit serves as the input of the gas expansion and transport subassembly 110. As mentioned earlier that subassembly is provided to receive liquified gas from the vessel 102 so that the liquified gas can vaporize in the conduits to return to its native gaseous state at an elevated pressure for pressurizing the dispensing chamber 22.

As will be appreciated by those skilled in the art, when the liquified gas vaporizes in the conduits making up the gas expansion and transport subassembly 110 it changes from its low pressure, liquid state to a relatively high pressure, gaseous state. Depending on the type of beverage that is to be dispensed from the chamber 22, the pressure of gas to be provided into that chamber must be regulated at different pressure levels. For example, when carbonated beverages, such as soft drinks, are dispensed, it is desirable to regulate the gas pressure provided by gas transport subassembly to the chamber so that it does not to exceed 10 p.s.i. This pressure limiting is accomplished by the preset head pressure valve 116. That valve is connected to the other outlet of the T-connector 148 via the conduit 152 and is thus in fluid communication with the interior of the cryogenic vessel. Accordingly, by setting the preset head pressure valve to 10 p.s.i. the internal pressure at the outlet port 154 of the cryogenic vessel is regulated not to exceed 10 p.s.i. The liquified gas which exits the cryogenic vessel through the outlet port is typically in a partially liquid, partially gaseous state.

The second outlet port 154 of the cryogenic vessel is in fluid communication with the conduit 118 which forms the input of the expansion and gas transport subassembly 110. That conduit 118 is connected in fluid communication with one end of the first coiled conduit section 126. The first coiled conduit section 126 is connected in fluid communication with one end of the second coiled conduit section 128. The second coiled conduit section 128 is connected in fluid communication with one end of the third coiled conduit section 130. The other end of the third coiled conduit section is connected to and in fluid communication with the adjustable regulator 132. Accordingly, as the liquified gas enters into the conduits making up the subassembly 110 it heats up, expands and turns from liquid into gas (i.e., vaporizes). The subassembly 110 is designed so that after the liquified gas has travelled through the coiled conduit sections 126, 128, and 130 and has reached adjustable regulator 132, it will be in its fully gaseous state.

As will be appreciated by those skilled in the art there are several parameters controlling the rate at which the liquified gas changes from its liquid to its gaseous state as it travels from the cryogenic vessel 102 to the adjustable regulator 132. These parameters include the thickness of the walls of the conduits, the diameter of the conduits, the number of turns of coils in the coiled conduit sections, and the length of the path through all of the conduits between the cryogenic vessel outlet 152 and the adjustable regulator 132. By proper design of the components of the subassembly 110, one can ensure that all liquified gas will have been converted its from liquid to its fully gaseous state, thereby maximizing the gas pressure just upstream of the regulator. When the dispenser 20 of this invention is used to dispense carbonated beverages the pressure just upstream of the adjustable regulator is approximately 54 p.s.i.

The adjustable regulator is manually adjustable to establish the pressure of the gas to be introduced into the interior of the chamber 22. Typically, carbonated beverages are dispensed from the tank at approximately 50 p.s.i. This pressure is desirable to prevent the loss of carbon dioxide from the carbonated beverage. Coffee, being a non-carbonated beverage, can be dispensed at a substantially lower pressure, e.g., typically at 4 to 6 p.s.i. The adjustable regulator is preset at the desired pressure at the time the beverage is filled in the chamber of the tank, and is preferably not intended to be adjusted in the field.

The pressure regulator 132 is connected in fluid communication with a conduit 120. The conduit terminates at a input to a T-connector 156 (FIG. 4). One output of the T-connector 156 is connected in fluid communication with the heretofore identified head pressure check valve 134. The other output of the T-connector 154 is connected in fluid communication with the conduit 122. The conduit 122 is in turn connected in fluid communication with the theretofore identified ON/OFF valve 136. This valve includes a handle 136A at the top thereof which is arranged to be rotated to either open or to close the valve. The outlet of the ON/OFF valve is connected via the conduit 124 to the interior space 96 in the dispensing chamber 22 at the upper end thereof. When the ON/OFF valve is opened, pressurized gas is enabled to travel from the regulator 132 through conduit 120 to the head pressure check valve 134. The valve 134 is preset to a maximum pressure which the gas can attain before entering into the dispensing chamber 22. Accordingly, the interior of the dispensing chamber will be pressurized at the pressure as established by the regulator and in the event that that pressure attempts to exceed the preset maximum pressure of the check valve 134, the check valve opens to vent the gas to the ambient, thus preventing the interior of the chamber 22 from being excessively pressurized.

When the interior of the dispensing chamber is sufficiently pressurized the ON/OFF valve is closed, thereby preventing any further gas from entering the chamber. The gas introduced into the chamber pressurizes the upper region 96 of the chamber above the surface 98 of the beverage 100. This pressurized region produces a downward force on the beverage, which cooperates with gravity, to expel the beverage from out of the chamber 22 via the conduit 64 and the associated dispensing hose and nozzle assembly 18 when the nozzle is opened. As the beverage is dispensed, the beverage level drops and the pressure within the dispensing chamber decreases. The dispensing chamber 22 can be readily repressurized to the desired pressure by merely opening the ON/OFF valve 136.

As should be appreciated from the foregoing the cryogenic pressurization system 14 just described is particularly suited for dispensing carbonated beverages, since the pressurized gas introduced into the dispensing chamber 22 is at a substantially elevated pressure. This high pressure not only provides the motive force to effect the dispensing of the beverage from the chamber when the nozzle assembly is actuated, but also helps maintain the carbonation of the beverage therein.

As can be seen in FIG. 4 the dispenser of this invention also includes a pump assembly 158 like that disclosed in my aforementioned patent. The pump assembly 158 is provided for use in the event that the gas pressurization system 14, described earlier, is unavailable, e.g., the cryogenic vessel 102 is empty. Moreover, the pump assembly 158 can be used in applications wherein the cryogenic pressurization system isn't needed. For example, if the beverage to be dispensed is non-carbonated, e.g., coffee, the high pressure generated by the pressurizing gas from the cryogenic system is not needed for maintaining any carbonation. Thus, all that is required is to provide sufficient pressure within the chamber to dispense the beverage therefrom. Such pressure can be easily produced by the vendor operating the pump assembly in the same manner as described in my aforementioned patent.

The pump assembly 158 includes a hand actuated pump 160 having a gas (e.g., air) accumulation chamber or housing (not shown) in which a piston 161 or plunger is mounted for linear movement. Downward movement of the plunger directs air into the accumulation chamber or housing, and upward movement of the plunger forces the air out of the accumulating chamber into a pump outlet conduit 162 (FIG. 4) connected to an inlet 164 in communication with the interior 96 of the upper end of the beverage dispensing chamber 22. The chamber inlet 164 is connected at one end to the pump outlet conduit through a conventional one-way check valve (not shown).

In use the chamber 22 is preferably initially filled with the beverage to be dispensed to a level just below the inlet. Accordingly, when the pump is used for pressurizing the chamber, operation of the pump causes the pressurizing air introduced into the chamber to fill the upper region 96 of the chamber 22 to create a force applied downwardly on the beverage.

The pump 160 is oriented in a generally vertical direction substantially parallel to the elongate dimension of the tank. In this orientation the pump can easily be operated by reciprocating the plunger 161 in a linear direction substantially parallel to the orientation of a vendor carrying the beverage dispenser. Thus, even when a vendor is in crowded quarters he or she can easily manipulate the plunger without hitting, and possibly injuring, people in the crowd.

The strap assembly 20 for supporting the dispenser on the back of a vendor is the same as that disclosed in my aforementioned patent and basically comprise a pair of shoulder straps 166, a waist strap 168, plural mounting straps 170, and associated mounting hardware, e.g., screws 172. That assembly provides a very comfortable means for supporting the dispensing device 10 on a vendor for extensive period of time.

Without further elaboration the foregoing will so fully illustrate my invention that others may, by applying current or future knowledge, adapt the same for use under various conditions of service.

I claim:

1. A portable beverage dispenser for use by a vendor, said dispenser comprising:

(a) a tank having an internal chamber for receiving a carbonated beverage to be dispensed, said chamber having a longitudinal axis and comprising a concave bottom wall having a concave recess at its nadir and centered on said axis, said concave recess having a substantially smaller radius of curvature and volumetric capacity than said bottom wall;

(b) conduit means extending into said chamber at an acute angle to said axis, said conduit means having a port centered on said axis and disposed immediately adjacent said concave recess, said conduit means being arranged to carry said carbonated beverage therethrough and out of said port into said chamber, whereupon said carbonated beverage enters said recess and quickly fills it with minimal foaming and so that the level of said carbonated beverage in said chamber is above said port, whereupon further filling of said chamber with said carbonated beverage is accomplished with minimal foaming; and (c) pressurizing means for pressurizing said chamber with a gas above the level of said carbonated beverage in said chamber to dispense a portion of said carbonated beverage from said chamber.

2. The portable beverage dispenser of claim 1 additionally comprising nozzle means arranged to be coupled to said conduit means for dispensing said portion of said carbonated beverage from said chamber.

3. The portable dispenser of claim 1 wherein said port has a cross sectional area which is almost as large as the cross sectional area of said recess.

4. The portable beverage dispenser of claim 1 wherein said tank is insulated.

5. The portable beverage dispenser of claim 1 wherein said pressurizing means comprises a vessel having a gas in a liquid phase located therein, said vessel being in communication with said chamber to selectively enable said liquified gas to exit from said vessel, whereupon said liquified gas returns to its gaseous phase to pressurize said chamber.

6. The portable beverage dispenser of claim 5 wherein said vessel is thermally insulated, and wherein said liquified gas is maintained in said vessel at a very low temperature.

7. The portable beverage dispenser of claim 5 additionally comprising fill valve means coupled to said vessel for enabling said vessel to be filled with said liquified gas from an external source.

8. The portable beverage dispenser of claim 7 additionally comprising bleed valve means coupled to said vessel for enabling excess liquified gas to be bled from said vessel.

9. The portable beverage dispenser of claim 5 additionally comprising additional conduit means having plural coils, said additional conduit means being coupled to said chamber and being arranged to selectively receive said liquified gas from said vessel, whereupon said liquified gas returns to its gaseous state in said additional conduit means, said gas in said gaseous state being at an elevated pressure within said additional conduit means and in fluid communication with the interior of said chamber to pressurize said chamber.

10. The portable beverage dispenser of claim 9 additionally comprising regulator means coupled to said additional conduit means for regulating the pressure of said gas within said additional conduit means.

* * * * *